US011278160B2

(12) United States Patent
Harding et al.

(10) Patent No.: US 11,278,160 B2
(45) Date of Patent: Mar. 22, 2022

(54) HAND SANITIZER DISPENSING DEVICE

(71) Applicants: Jonathan Cole Harding, Denver, CO (US); Michael Barnett, Denver, CO (US)

(72) Inventors: Jonathan Cole Harding, Denver, CO (US); Michael Barnett, Denver, CO (US)

( * ) Notice: Subject to any disclaimer, the term of this patent is extended or adjusted under 35 U.S.C. 154(b) by 6 days.

(21) Appl. No.: 16/796,890

(22) Filed: Feb. 20, 2020

(65) Prior Publication Data

US 2021/0259482 A1 Aug. 26, 2021

(51) Int. Cl.
*A47K 5/12* (2006.01)
*G16Y 40/30* (2020.01)

(52) U.S. Cl.
CPC ..... *A47K 5/1208* (2013.01); *A47K 5/1211* (2013.01); *A47K 5/1217* (2013.01); *G16Y 40/30* (2020.01)

(58) Field of Classification Search
CPC ..... A47K 5/1208–1209; A47K 5/1211; A47K 5/1215; A47K 5/1217; A47K 5/14; G16Y 40/30
USPC .... 222/190, 383.1, 321.7–321.9, 180–181.3, 222/185.1
See application file for complete search history.

(56) References Cited

U.S. PATENT DOCUMENTS 4,815,635 A * 3/1989 Porter ..... B62J 9/22 222/136
5,158,218 A * 10/1992 Wery ..... B67D 1/0456 222/610
5,908,143 A * 6/1999 Crossdale ..... A47K 5/1204 222/52
7,819,413 B2 * 10/2010 White ..... B62J 9/22 280/281.1
8,240,508 B2 * 8/2012 Wegelin ..... B67D 7/348 222/52
8,672,187 B2 * 3/2014 Ophardt ..... A47K 5/1207 222/145.5
10,034,576 B2 * 7/2018 Barth ..... G08C 17/02
2005/0184097 A1 * 8/2005 LeBlond ..... A47K 5/12 222/181.3
2009/0236254 A1 * 9/2009 Jenkins ..... A47K 5/12 206/459.5
2009/0308887 A1 * 12/2009 Woo ..... A47K 5/1217 222/52

(Continued)

*Primary Examiner* — J C Jacyna
(74) *Attorney, Agent, or Firm* — Berg Hill Greenleaf Ruscitti LLP

(57) ABSTRACT

A hand sanitizer dispensing device and method of dispensing sanitizing fluid are disclosed. The device may be mounted to the stem of a scooter or to the tubes of a bicycle frame. The device has an outer shell, an inner pod that holds a bag of sanitizing fluid, and a top cover that secures the inner pod to the outer shell. A pump/nozzle assembly communicates with an actuator to selectively dispense the fluid. Manual activation is achieved by pulling on a lever of the actuator. Automatic activation is achieved by placing the hand(s) under the dispenser whereby a sensor senses the presence of a hand(s) to dispense the fluid. The device communicates wirelessly with a mobile communication device application allowing the user to purchase use of the dispensing device. User interfaces on the mobile communication device guide the user to execute the purchase and to unlock the device for use.

8 Claims, 9 Drawing Sheets

(56) References Cited

U.S. PATENT DOCUMENTS

| | | | | |
|---|---|---|---|---|
| 2013/0299518 | A1* | 11/2013 | McNulty | A47K 5/14 222/190 |
| 2014/0231459 | A1* | 8/2014 | Pelkey | A47K 5/1207 222/181.3 |
| 2016/0309967 | A1* | 10/2016 | Pelfrey | G05D 7/0676 |

* cited by examiner

HAND SANITIZER DISPENSING DEVICE

FIELD OF THE INVENTION

The invention relates to liquid dispensing devices, and more particularly, to a hand sanitizer dispensing device and associated method especially adapted for mounting on a mobile transportation items such as a scooter or bicycle.

BACKGROUND OF THE INVENTION

Hand sanitizer dispensing devices are commonly found in many public locations. For example, locations such as medical or dental offices, gyms, and retail stores provide hand sanitizing fluid with the intent to prevent the spread of communicable diseases in such public places.

Hand sanitizing fluid is typically dispensed from a flexible bag type container in which fluid is withdrawn from the flexible bag to dispense the fluid through a connected nozzle. It is well known to dispense sanitizing fluid through a conventional pump dispenser, similar to the dispensing of body lotion, shampoo, or other toiletry liquids.

Recently, public transportation, particularly in crowded metropolitan areas, provides non-traditional transportation means such as scooters and bicycles. These means of transportation are relatively inexpensive and simple to employ for people who require transportation across short distances. Today, many downtown areas in cities provide both bicycle and scooter rentals in which a user may execute the rental transaction by a credit card reader incorporated on the bicycle/scooter. Through a credit card, the identity of the user is confirmed. GPS tracking is also commonly used to confirm the location of the bicycle/scooter to prevent theft.

Considering the increasing use of non-traditional means of transportation within shorter transportation routes, there is also a need to provide a convenient, nonintrusive hand sanitizing dispenser so that a user may keep their hands clean. Considering the number of uses of the bicycle/scooters, the hand sanitizing fluid could be used with a sterile wipe provided by the user or by a separate paper product that could be soaked with the hand sanitizer allowing a user to wipe down the handles, seat, and any other location on the bicycle/scooter.

It is common to find freestanding hand sanitizer dispensing stands in such locations in which the dispensing device is secured to a bracket position that the top end of the dispensing stand. More specifically, the dispensing stand typically has a base similar to a standing lamp, and a single vertical post with the bracket at the top end thereof.

With respect to use of a hand sanitizer dispensing device directly mounted on a scooter or bicycle, special modifications are required to a standard dispensing device. Further, in order to improve the ability to selectively dispense a desired amount of sanitizing fluid, there must also be modifications made to how the dispenser is activated by a user.

In connection with the present invention, modifications and improvements are provided for a hand sanitizer dispensing device that can be directly mounted to a scooter or bicycle. Further, the method by which the device is activated is also optimized such that the user can quickly and efficiently dispense a desired quantity of the sanitizing fluid.

SUMMARY OF THE INVENTION

The invention comprises a hand sanitizer dispensing device and method of dispensing a sanitizing fluid. The device is especially adapted to be mounted on a transportation device such as a scooter or bicycle. The structure of the device includes an outer frame or shell that is directly mounted to the transportation device, such as by a zip tie, hook and pile strap, or other means of attachment. The outer frame receives an inner pod that holds a container of sanitizing fluid. The front face of the device has a front cover that is placed over the front open face of the inner pod to secure the fluid container.

In a manual mode, a handle or lever is used to dispense the sanitizing fluid. The handle or lever is connected to a rack and pinion type actuator mechanism. The actuator mechanism allows dispensing of the sanitizing fluid through a pump/nozzle piece of the fluid container. The pump/nozzle piece is operated to draw fluid into the pump and then delivers fluid through the nozzle.

Components of the actuator mechanism include two spaced gear supports with rack gears and an actuator plate that interconnects the gear supports. The lever has a stem that terminates with a transverse pin mounted between a pair of brackets within the outer shell. The opposite ends of the pin each have corresponding pinion gears that engage the rack gears. The actuator plate contacts the pump and nozzle piece. In order to dispense sanitizing fluid, the user grasps the lever and causes it to move back and forth thereby operating the pump. The actuator plate causes a depressible sleeve of the pump to be repeatedly depressed and released thereby causing the pump to successively pressurize a container of sanitizing fluid (such as a flexible bag) to thereby dispense the fluid through the connected nozzle. Alternatively, in another mode of fluid dispensing, the pump and nozzle piece can be a conventional spray nozzle device in which sanitizing fluid is withdrawn or pulled from the reservoir of fluid in the bag and then sprayed or discharged through the nozzle.

The rear surface of the outer shell has a concave shape that receives the stem or tube of a scooter or bicycle. The concave shape assists in maintaining the device in a securely mounted position since the surface area in contact is increased by the complementary concave shape.

In order to replace the bag of sanitizing fluid, the front cover is removed, the spent bag and the connected pump/nozzle piece is removed from within the inner pod. A new bag of fluid is placed within the inner pod and the front cover is then reattached. The front cover has a pair of upper engaging tabs that are resiliently received in corresponding retaining slots formed in the upper portion of the outer frame. To remove the front cover, the upper engaging tabs are depressed by a key device that allows the tabs to be disengaged from the retaining slots. To replace the front cover, it is realigned with the inner pod and the cover is aligned to snap the engaging tabs back into their corresponding retaining slots.

In the preferred embodiment of the device, the exposed lever extends away from the lower surface of the outer shell enabling it to be easily grasped by the user. The hand sanitizer device may therefore be operated by the user at any desired position with respect to the scooter or bicycle upon which the dispensing device is mounted.

According to another embodiment of the invention, dispensing is achieved in an automatic manner by use of a sensor that senses the motion or heat signature of a hand placed under the dispenser. The sensor is electrically connected to the pump/nozzle piece and activates the pump portion of the pump/nozzle piece to dispense fluid. Any type of sensor can be used that electrically connects to the pump to activate the pump once a user's hand is sensed. Examples of sensors include photo sensors, passive infrared sensors, and others. The pump portion of the pump/nozzle piece may be battery powered.

According to a method of the invention for manual activation, dispensing of a sanitizing liquid is provided. A dispenser device is secured to an object such as a scooter or bicycle. The dispensing device is loaded with a flexible bag of sanitizing liquid that has an integral pump/nozzle piece. A user grasps the lever and moves it back and forth or in a reciprocating action to dispense a desired quantity of the sanitizing liquid. The lever rotates about an axis oriented in a transverse direction to the front and rear sides of the dispensing device. The extent of rotation of the lever is limited by the length of an opening formed in the lower surface of the outer shell.

According to the method of the invention for automatic activation without requiring the user to move the lever, the user simply places his/her hands under the dispensing device and fluid will be dispensed as actuated by the sensor that communicates with the pump.

According to another aspect of the invention, the device of the invention may be controlled for activation and deactivation in conjunction with the device being used on a scooter or bicycle. In this regard, the invention may further include a mobile communication application or "App" capability that allows the user to control the dispensing device as a supplemental function of the scooter or bicycle. More specifically, it has recently become popular to provide shared scooters and bicycles that can be rented by use a mobile phone. The user has an App on downloaded on their mobile phone that allows the user to select the scooter or bicycle (hereinafter also referred to as a "transport") at a convenient location close to the user. The technology supporting such an App includes a GPS capability in which the location of the user is known and available transports are shown on a user interface map. The user is previously registered on the App with proper identifying credentials in order to execute an online rental transaction. One example of how the rental transaction occurs is that the transport has a scanner that scans a QR code displayed on the user's phone that is created upon executing the rental transaction. Once the QR code is successfully scanned the scooter is unlocked and may be used by the user until the user decides to cease use by closing out the rental transaction on the user's phone App. In the present invention, the same technology can be employed in which scanning the QR code on the scanner installed on the scooter or bicycle allows the dispensing device to be unlocked for use. One commercial example of a scooter rental transaction that can be executed on a phone App is Bird. Basic information available on the technology to include instructions on how to download a Bird App and conduct a rental transaction may be found on www.bird.co.

Scooters and bicycles that can be rented by use of a mobile phone are Internet of Things (IoT) devices. The Internet of Things (IoT) is a network of "smart" devices that are connected to and communicate over a designated communications network such as the Internet. An IoT device can collect and exchanging information through embedded software, sensors, cameras, and other components that sense and record data relating to observed parameters such as distance and movement. Smart devices like shared scooters and bicycles are controlled and monitored remotely.

Functionality associated with use of an App in the present invention is related to unlocking the dispensing device for use wherein additional functionality could be employed such as the period of time the dispensing device is unlocked for use and the number of times the dispensing device is activated for use.

Considering the foregoing features of the invention, in one aspect, it may be considered a hand sanitizing dispensing device for dispensing a quantity of fluid therefrom, comprising: an outer shell; an inner pod received through an open front of said outer shell; a front cover placed over a front surface of said inner pod and said front cover having a rear edge that connects with a front edge of said outer shell; actuator means connected to said shell; a pump communicating with said actuator means, said pump having a nozzle opening for dispensing sanitizing fluid; said actuator means connected to a lever allowing a user to operate said actuator means and to engage said pump to dispense sanitizing fluid; and wherein said lever is moved back and forth causing said actuator to contact said pump to withdraw sanitizing fluid from a flexible bag type container and subsequently causing sanitizing fluid to be dispensed through said nozzle opening.

In another embodiment of the invention, it may be considered a hand sanitizing dispensing device for dispensing a quantity of fluid therefrom, comprising: an outer shell; an inner pod received through an open front of said outer shell; a front cover placed over a front surface of said inner pod and said front cover having a rear edge that connects with a front edge of said outer shell; actuator means connected to said shell; a pump communicating with said actuator means, said pump having a nozzle opening for dispensing sanitizing fluid; said actuator means including a sensor that senses the presence of a user's hand; and wherein sensing the presence of the user's hand results in said actuator to activate said pump to withdraw sanitizing fluid from a flexible bag type container and subsequently causing sanitizing fluid to be dispensed through said nozzle opening.

In another aspect of the invention, it may be considered a method of dispensing sanitizing fluid from a hand sanitizing dispensing device comprising (a) providing a hand sanitizer device comprising an outer shell, an inner pod received through an open front of said outer shell, a front cover placed over a front surface of said inner pod and said front cover having a rear edge that connects with a front edge of said outer shell, an actuator mounted in said shell, a pump communicating with said actuator, said pump having a nozzle opening for dispensing sanitizing fluid, and actuating said actuator to cause sanitizing fluid to be dispensed through said nozzle opening.

According to another aspect of the invention, it may be considered a method of dispensing sanitizing fluid from a hand sanitizing dispensing device activated through a mobile phone application (App) comprising: (a) providing a hand sanitizer device comprising an outer shell, an inner pod received through an open front of said outer shell, a front cover placed over a front surface of said inner pod, an actuator mounted in said shell, a pump communicating with said actuator, said pump having a nozzle opening for dispensing sanitizing fluid; (b) providing an App installed on a mobile communication device, said App having a plurality of user interfaces enabling a user to select activation of said dispenser device; (c) conducting a rental transaction for a transport utilizing said App such that the user executes the rental transaction by a QR code appearing on the user's mobile communication application that activates the transport; (d) further using the App to selectively unlock the sanitizer device for use; and (e) actuating said actuator to enable sanitizing fluid to be dispensed through said nozzle opening.

According to this method of dispensing, the App that controls the dispensing device can be incorporated within the same App that controls the transport IoT device. Alternatively, the App that controls the dispensing device can be a separate App that communicates with the App that controls the transport IoT device.

According to yet another aspect of the invention, it may be considered a combination of a hand sanitizer device mounted to a transport such as a bicycle or scooter. The hand sanitizer device, as mentioned, may be mounted to the vertical stem or steering column of a scooter or to one of the frame tubes of a bicycle.

Other features and advantages of the invention will become apparent from a review of the drawings in connection with the detailed description that follows.

DETAILED DESCRIPTION OF THE DRAWINGS

Figure 1:
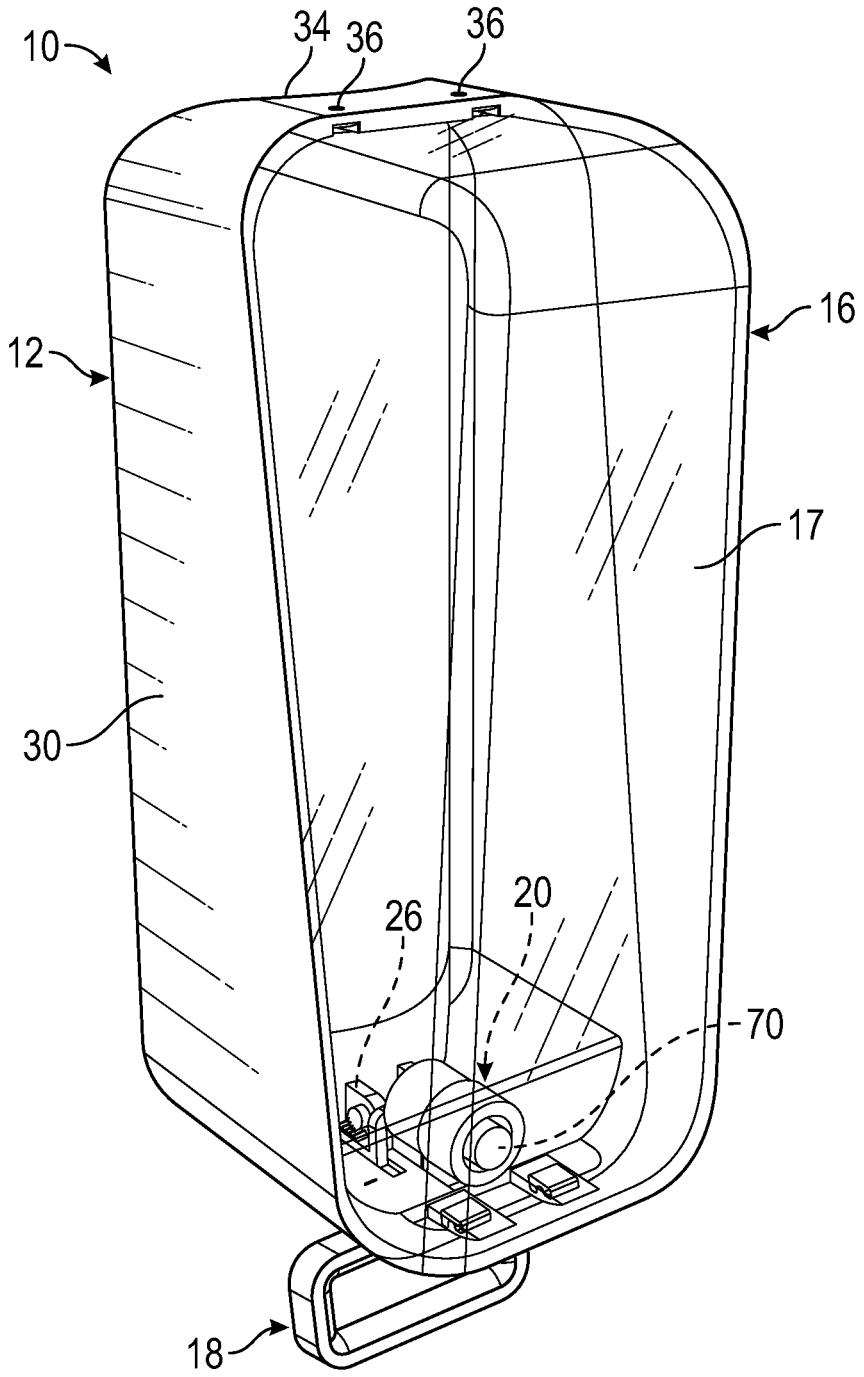
FIG. 1 is a front perspective view of the dispensing device of the invention.

Referring to FIGS. 1-4, these illustrate a preferred embodiment of the hand sanitizer dispensing device 10 of the invention. The dispensing device 10 is shown in an upright position. Descriptions follow regarding the orientation of the components of the dispensing device. It should be understood that references made to terms including "upper" and "lower, "front" and "rear" and others of the components, do not require that the device be mounted in the upright position. Rather, the device can be mounted at any particular orientation. Accordingly, references made herein for terms relating to the particular orientation of the components are simply to provide an explanation of the structure of the device and the arrangement of the elements of the device with respect to one another.

The device 10 has an outer shell 12 forming a rear portion of the device. The outer shell 12 has a continuous sidewall or outer surface 30 that has upper and lower surfaces and opposing side or lateral surfaces. The front face of the outer shell 12 is defined by a forward or front edge 56 that has a generally rectangular shape. The width of the outer shell 12 is wider at the lower end as compared to the upper end thereof. The interior rear surface 38 of the outer shell 12 has a convex curvature shape oriented along a long or longitudinal axis of the outer shell.

Figure 2:
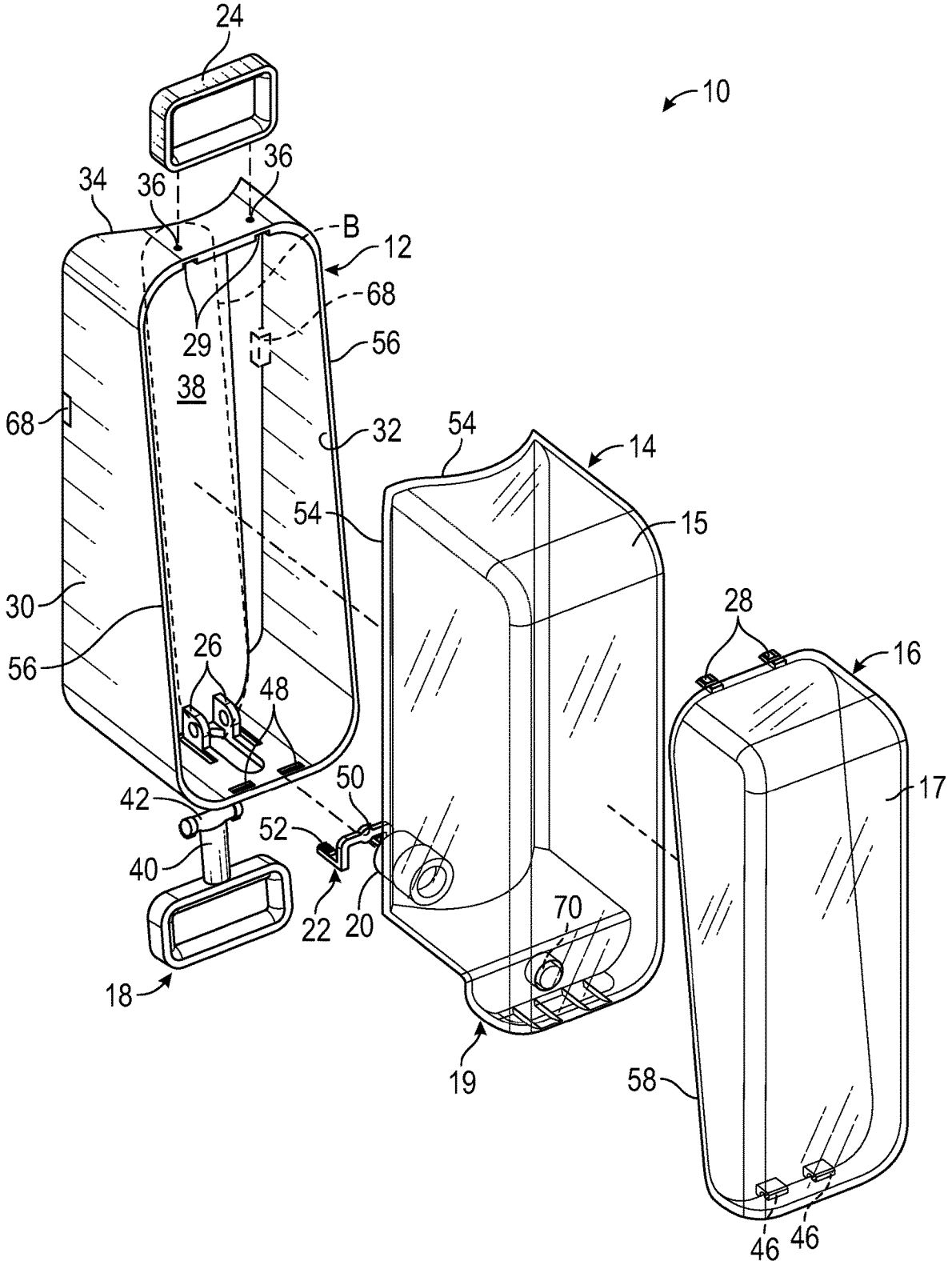
FIG. 2 is an exploded front perspective view of the dispensing device.
Figure 3:
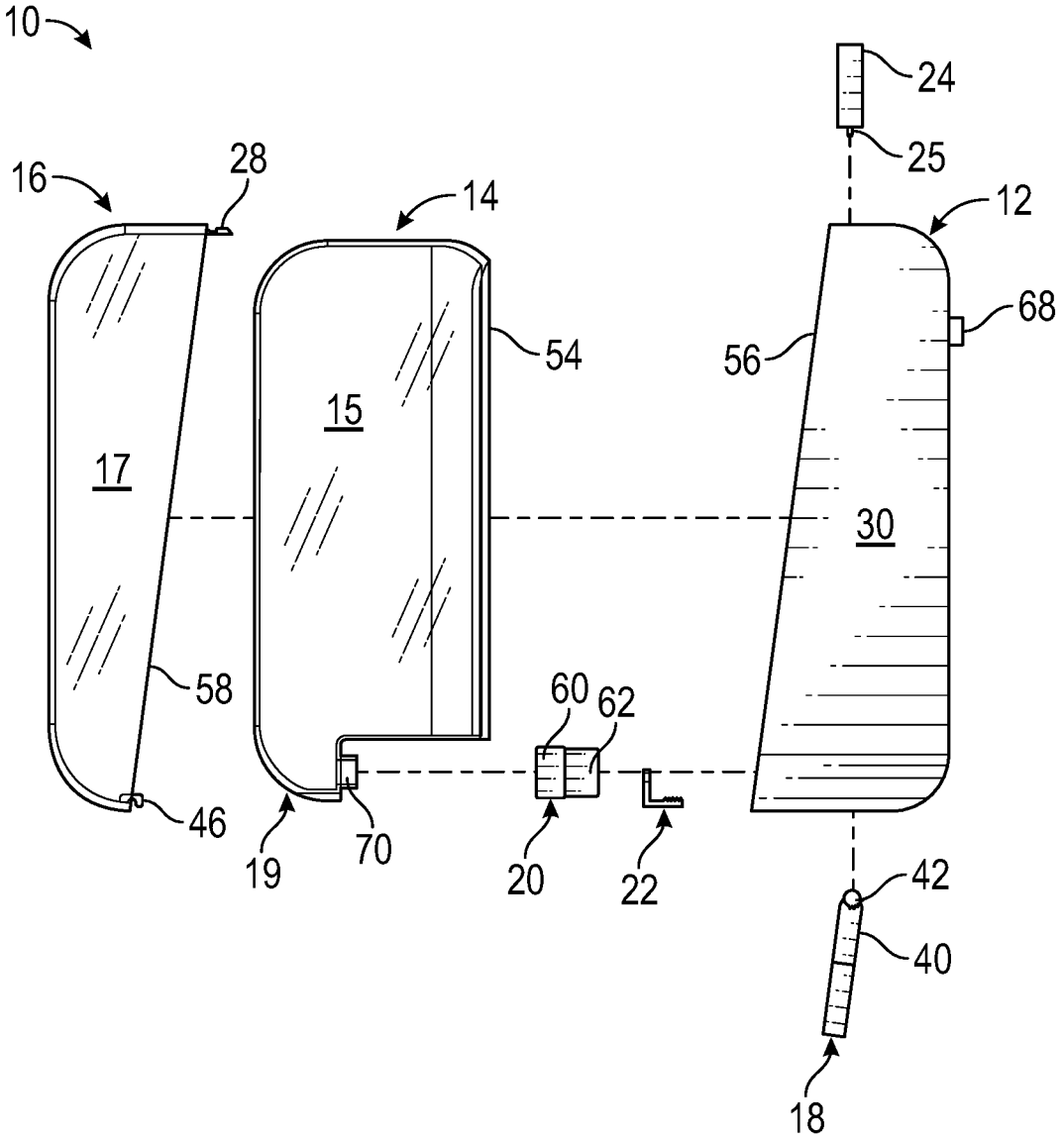
FIG. 3 is an exploded side elevation view of the dispensing device.

An inner pod 14 made of a preferably a clear molded plastic piece is held within the outer shell. The inner pod 14 also has a continuous outer surface 15 with corresponding upper and lower surfaces, corresponding lateral side surfaces, and a front face as shown. As best shown in FIG. 2, the inner pod 14 also has a depending or overhanging edge 19 that accommodates connection of the pump/nozzle piece or pump 20 as set forth below. When secured within the outer shell 12, the rear edge 54 of the inner pod 14 abuts the interior rear surface 38 of the outer shell 12. The upper and lower portions of the rear edge 54 have complementary concave shapes to match the convex shape of the interior rear surface 38. The inner pod 14 may have an open rear side or the inner pod may have a closed rear side in which case the container of sanitizing fluid is sealed within the inner pod.

The front cover 16 is also made of a preferably a clear molded plastic piece and is placed over the inner pod 14. Like the outer shell and inner pod, the front cover 16 also has a rectangular shape and a continuous outer sidewall or outer surface 17. In order to secure the front cover, lower engaging tabs 46 of the front cover 16 are placed within matching engagement slots 48 in the lower surface of the shell 12. The front cover is then rotated so that the upper engaging tabs 28 are slid into the upper engaging slots 29 of the shell 12. The rear edge 58 of the front cover 16 abuts the front edge 56 of the outer shell 12.

Figure 5:
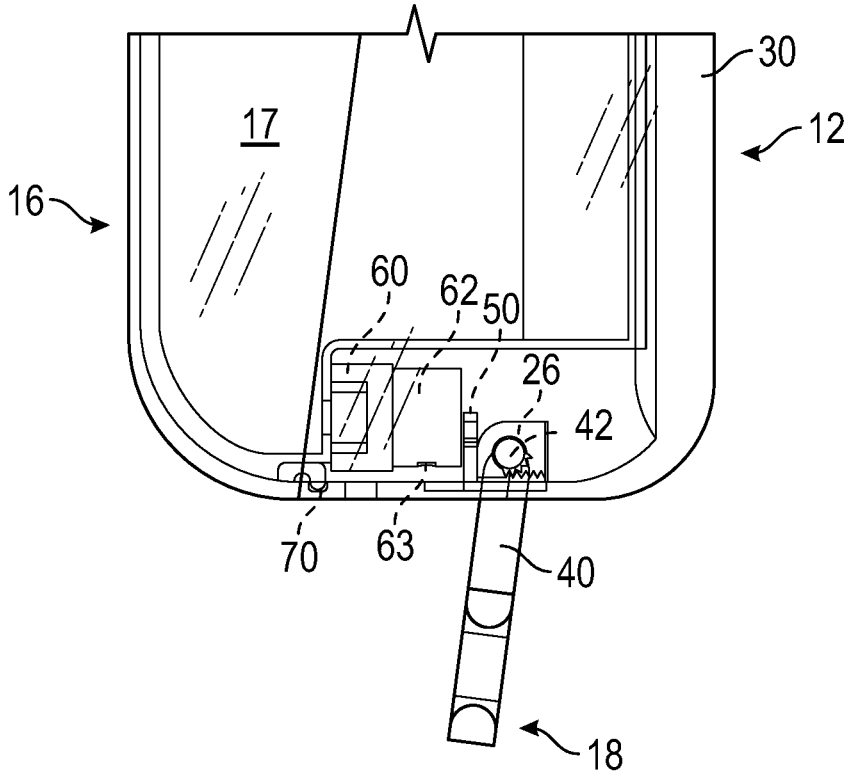
FIG. 5 is an enlarged side elevation view of a lower portion of the dispensing device.
Figure 6:
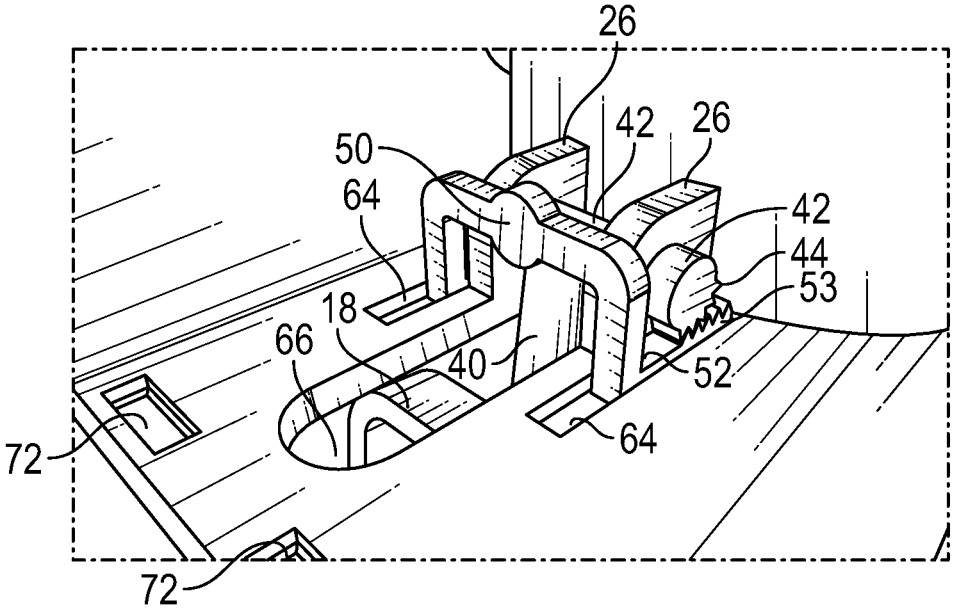
FIG. 6 is a greatly enlarged fragmentary perspective view of the lower interior portion of the outer shell showing the actuator mechanism of the dispensing device.

Referring also to FIGS. 5 and 6, elements making up the actuator mechanism and the pump/nozzle 20 are shown. The actuator mechanism includes a pump actuator 22 and pin 42 with pinion gears 44 formed on each end thereof. The pin 42 is mounted transversely to the upper end of the stem 40 of the handle or lever 18. The pump actuator 22 comprises two spaced rack supports 52 with rack gears 53 (FIG. 6) that cooperate with the pinion gears 44. The rack supports 52 are interconnected by an actuator plate 50. As best seen in FIG. 6, the stem 40 extends from the handle or lever 18 and protrudes through a stem opening 66 located on the lower surface of the outer shell 12. Two rack support grooves 64 are formed on the lower surface of the outer shell and are disposed on opposite lateral sides of the lever opening 66. The rack supports 52 are secured within the grooves 64. A pair of brackets 26 extends upwards from the lower interior surface of the outer shell. The pin 42 is secured within openings made on the brackets 26 such that the pinion gears 44 are exposed at each end. The pinion gears 44 are aligned with and engage the rack gears 53.

Figure 4:
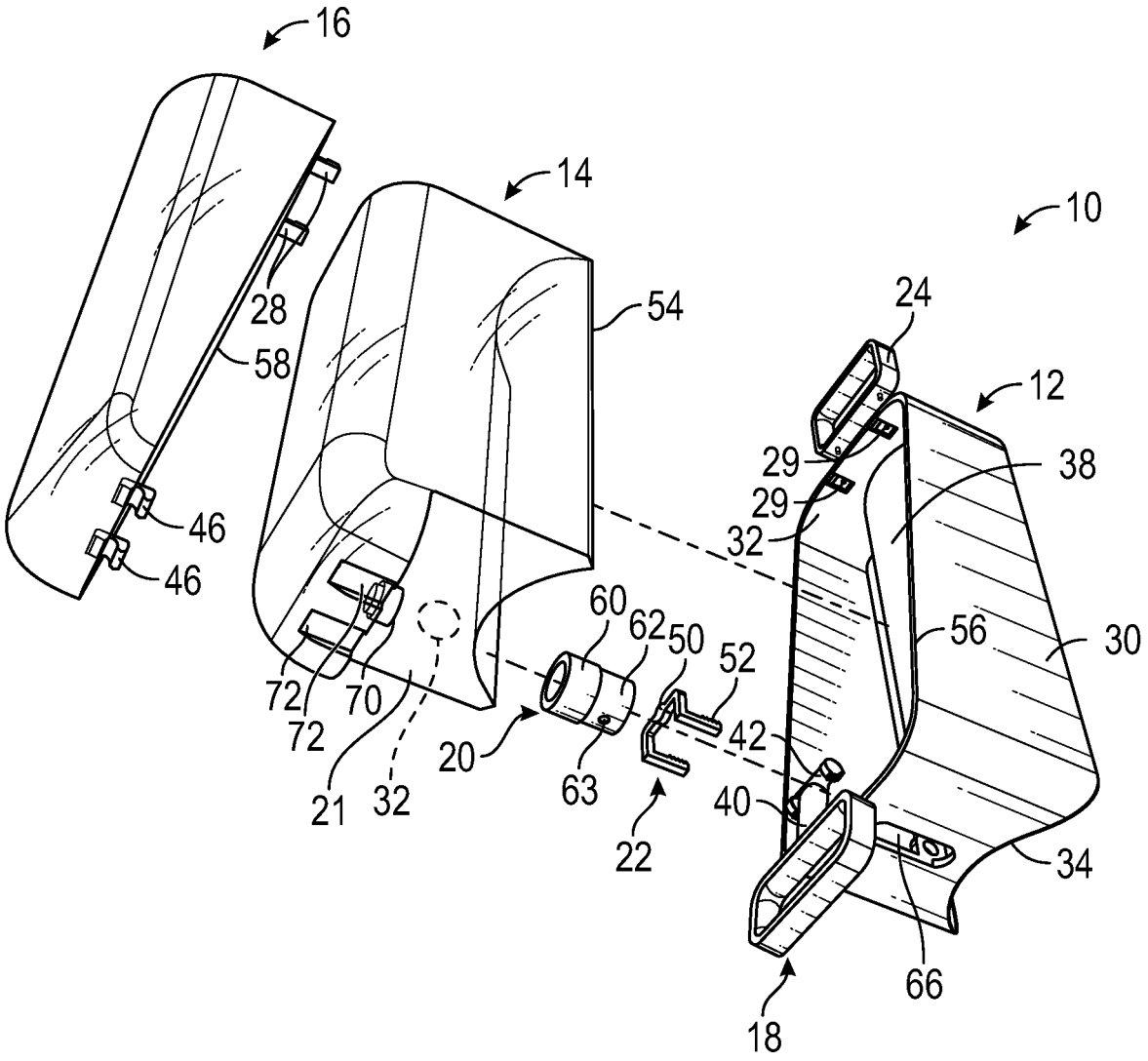
FIG. 4 is a bottom perspective view of the dispensing device.

The pump/nozzle piece 20 is mounted within the inner pod 14. The pump/nozzle piece 20 is intended to represent any type of manually operated unit that can pressurize a flexible container of material causing fluid to be forced through a nozzle, or a conventional spray bottle type pump comprising a trigger mechanism, piston, and cylinder. As shown, the pump/nozzle piece 20 has a stationary element 60 and a slidable element 62. Referring to FIG. 5, the front or forward edge of the stationary element 60 is secured to the inner pod 14 by the nozzle mount 70 that protrudes from the overhang 19. The slidable element 62 abuts the actuator plate 50. A flexible bag of sanitizing fluid (not shown) is connected to and sealed with the stationary element 60. The slidable element 62 resides outside of the flexible bag. As seen in FIG. 4, the slidable element 62 has a hole 63 that is exposed. Fluid dispensing openings 72 are provided on the lower surface of the overhang 19 allowing sanitizing fluid to pass.

For use of a conventional spray pump for the pump/nozzle piece 20, the slidable element 60 forces a piston (not shown) into a cylinder (not shown) that are both housed within the stationary element 60. Fluid within the cylinder is therefore displaced and forced through the nozzle. When the slidable element 62 is released, the piston retracts such as by the force of an internal spring (not shown) thereby pulling fluid back into the cylinder through the hole 63.

Although the pump 20 is illustrated as a two-element unit, it should be understood that this illustrated pump is but one example of a pump unit that can be used with the actuator mechanism. The pump actuator 22 can activate any type of pump unit with a depressible part that requires force to be applied thereto in order to operate the pump.

According to another embodiment of the invention, the actuator mechanism can be a sensor 32 (FIG. 4) that communicates electrically with the pump/nozzle piece 20 to control activation of the pump portion. In this regard, the pump is therefore an electrical pump and is not a manually operated pump. One advantage of this embodiment is that it eliminates the need for the lever 18 and the manual actuator mechanism in favor of a single sensor that controls the pump. As shown, the sensor 32 is mounted to the bottom or lower end 21 of the inner pod. When the hands of a user are placed under the dispensing device, the sensor 32 senses the presence of the user's hand(s) and then sends a control signal to the pump to pump fluid.

In order to replace a spent bag of sanitizing fluid, the front cover 16 is removed by use of a key 24. The key has two protruding pins 25 (FIGS. 3 and 4) that align with pin openings 36 formed on the upper surface of the upper shell 12. A user pushes the pins 25 through the holes 36 which results in depressing the upper engaging tabs 28. At this stage, the user can then pull the front cover away from the device. The inner pod 14 is slid away from the outer shell to expose the flexible bag. The pump/nozzle piece 20 is disconnected from the nozzle mount 70 and the spent bag and attached pump/nozzle piece are removed through the open rear side of the inner pod. A new bag of sanitizing fluid with the integral pump/nozzle piece 20 are placed within the inner pod. The nozzle side of the stationary element 60 is connected to nozzle mount 70. The inner pod is slid back into position within the outer shell 12, and the front cover 16 is then replaced over the inner pod 14.

Another configuration that can be used for the inner pod 14 is one in which the container of sanitizing fluid and the integrally attached pump/nozzle piece 20 are sealed within the inner pod 14. Accordingly, the entire inner pod 14 is replaced when the sanitizing fluid is spent.

In order to dispense fluid, a user grasps the lever 18 and moves it in a back-and-forth action in order to operate the pump/nozzle piece 20. The slidable element 62 reciprocates with respect to the stationary element 60 and air is thereby introduced into the flexible bag. Referring to FIG. 5, the user pulls the lever to the left in order to expose the air hole 63. As the user pushes the lever to the right, the actuator plate 50 causes the slidable element 62 to shift to the left thereby introducing air into the flexible bag. Each time the lever is pulled back and forth, additional air is introduced into the bag in this matter. When the bag is sufficiently pressurized, fluid within the bag can be dispensed through a small orifice (not shown) formed on the nozzle side of the stationary element 60. Alternatively, each time the lever is pulled back and forth, the slidable element 62 is reciprocated causing fluid to be displaced from within the cylinder within the stationary element 60 and hence fluid is ejected through the nozzle side of the stationary element. The dispensed fluid passes downward through the dispense openings 72 onto the user's hands. The paired pinion and rack gears 44 and 53 ensure that the actuator plate 50 remains aligned with the movable piece 62 of the pump.

It should be understood that while a particular construction is shown with respect to an exemplary pump/nozzle piece 20, it should be understood that other types may be incorporated within the invention in which the actuator plate 50 can be used to actuate a movable element of a pump.

Figure 7:
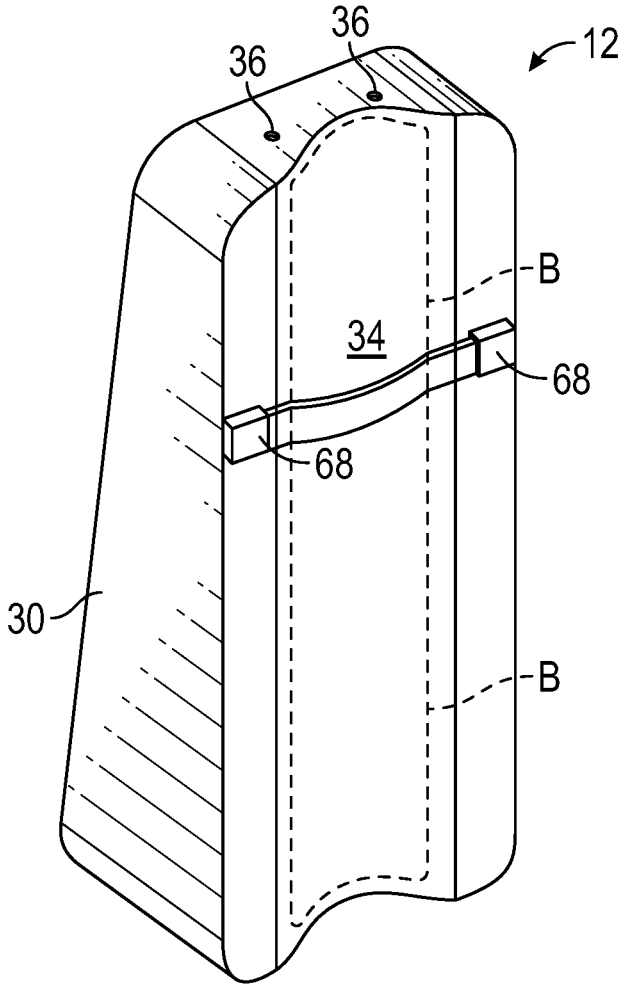
FIG. 7 is a rear perspective view of the outer shell specifically illustrating the concave shape thereof.

Referring to FIG. 7, the rear side 34 of the outer shell 12 is shown having a concave curvature. A vertical steering column C or stem of a scooter is illustrated in broken lines. This figure shows the concave shape allows for greater surface area contact between the outer shell and steering column C. The particular curvature of the rear side 34 can be adapted to best complement the steering column C of a scooter or frame tubes of a bicycle. A desired type of fastening means can be used to secure the device 10 to the steering column C, such as by zip ties, hook and pile fasteners, or similar securing means, these being generally indicated as securing means 68.

According to one method of the invention, the dispenser device 10 is secured to an object such as a shared transport (e.g. a scooter or bicycle) and more specifically, an IoT transport device. The dispensing device 10 is loaded with a flexible bag of sanitizing liquid with an integral pump/nozzle piece 20. A user grasps the lever 18 and moves it back and forth or in a reciprocating motion to dispense a desired quantity of the sanitizing liquid through the nozzle side of the piece 20. The lever rotates about an axis along the length of the pin 42. This axis is oriented in a transverse direction to the front and rear sides of the dispensing device. The extent of rotation of the lever 18 is limited by the length of the opening 66 formed in the lower surface of the outer shell 12. The extent of rotation can also be limited by the length of the rack gears 53 on the rack supports 52 in which stops (not shown) are provided at each end of the rack gears 53.

Figure 8:
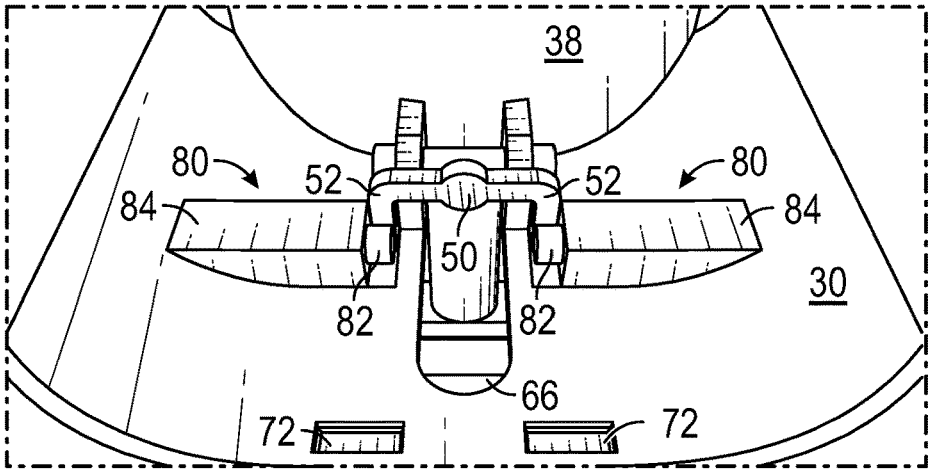
FIG. 8 is a greatly enlarged fragmentary perspective view of the actuator mechanism in another embodiment including a controllable solenoid for selectively locking and unlocking of the dispensing device.

FIG. 8 is a greatly enlarged fragmentary perspective view of the actuator mechanism in another embodiment including a controllable solenoid for selectively locking and unlocking of the dispensing device. In this embodiment, the actuator mechanism can be locked and unlocked by an electrical signal that controls two solenoid devices 80. The electrical signal can be produced by a controller unit (not shown) that is mounted to the IoT transport device. More specifically, the user operates the phone App to executes the purchase transaction of the transport device in which the user also selects to use the dispenser device. When the use transaction is completed, the electrical signal is sent from the controller to energize the solenoid causing the plunger or pistons 82 to withdraw into the respective solenoid bodies 84. In this energized position, the pistons 82 are cleared from the rack supports 52 so the lever 18 can be operated to dispense fluid. When the dispensing device is not authorized for use, the pistons 82 are returned to the extended positions as shown in this figure which prevents the lever 18 from moving.

Figure 9:
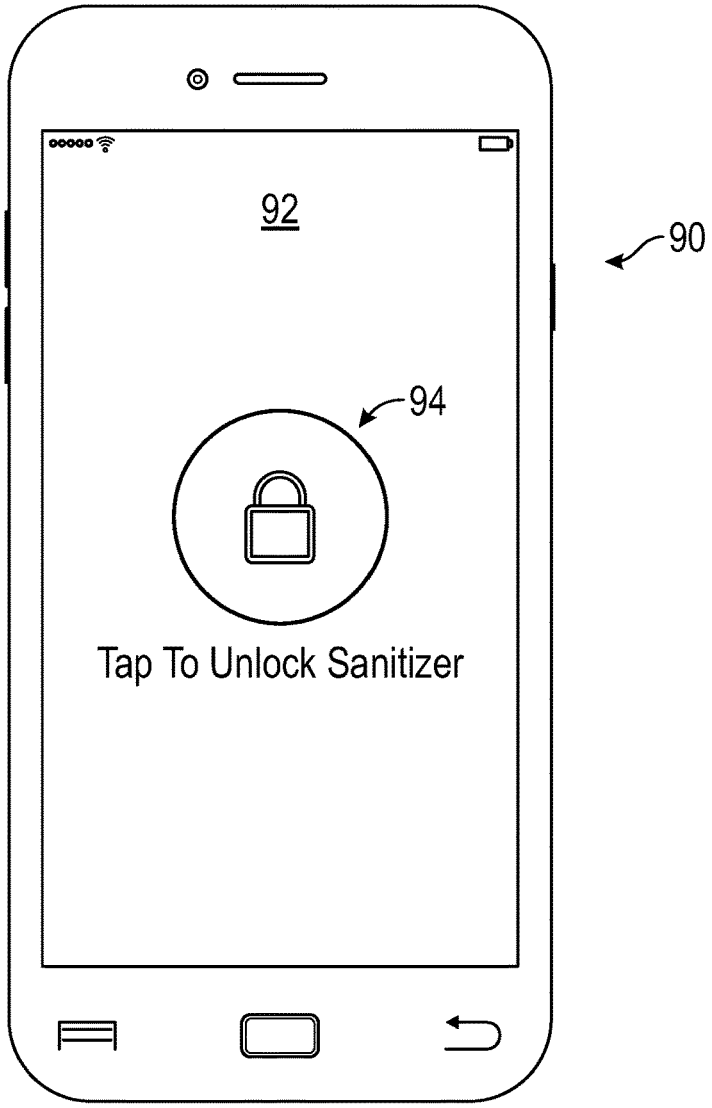
FIG. 9 is a sample user interface on a mobile communication device indicating the capability for a user to selectively control unlocking of the dispensing device.

FIG. 9 shows a sample user interface 92 on a mobile communication device 90 indicating the capability for a user to selectively control unlocking of the dispensing device. The communication device 90 runs a sanitizer dispensing device App that allows a user to control the dispenser device, such as through a rented IoT transport device. This user interface (UI) more specifically shows that the dispensing device is currently locked as indicated by an image 94 of a locked padlock. The text in the UI instructs the user to tap on the screen of the mobile device to unlock the sanitizer device. The command to tap the UI screen appears after the user has executed a rental transaction for the accompanying transport and could be an additional option for the user to choose when the user conducts the rental transaction and therefore, the sanitizer dispensing App is made part of the App used for executing the rental transaction of the transport. Alternatively, the sanitizer dispensing App can be a stand-alone App that is able to communicate with the IoT transport device to determine when the IoT transport device has been rented.

Figure 10:
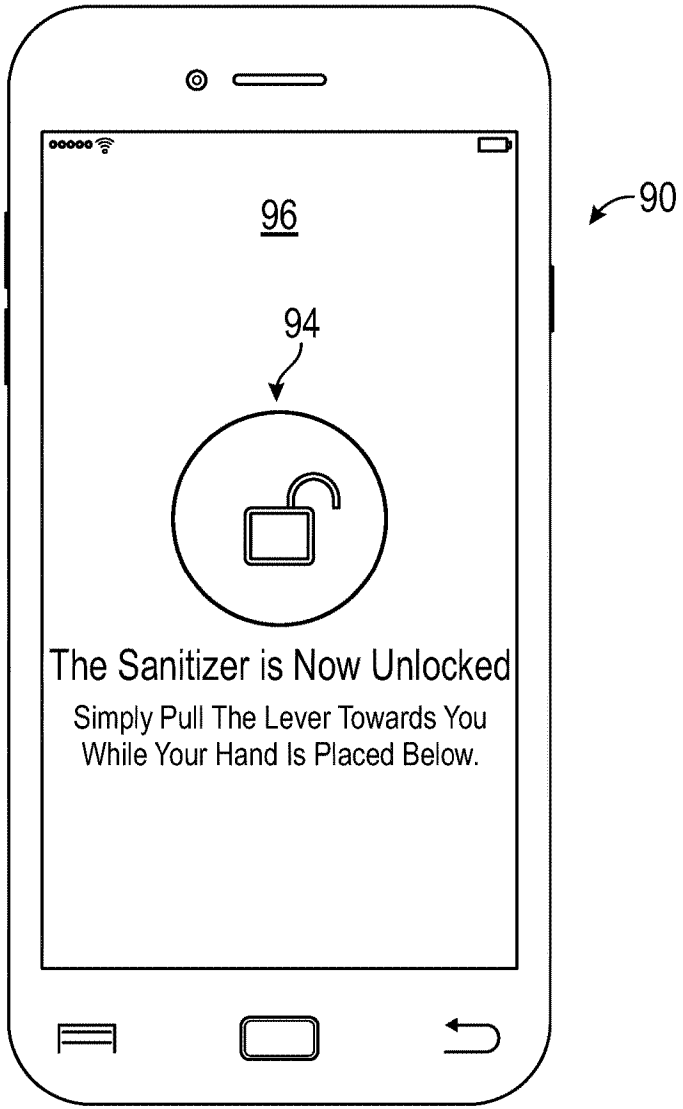
FIG. 10 is another sample user interface showing the device is unlocked and ready for use with respect manual activation of the device by pulling the lever.

FIG. 10 shows a sample user interface 96 indicating the device is unlocked and ready for use with respect manual activation of the device by pulling the lever. Accordingly, for this UI, it corresponds to the embodiment of the device that includes manual dispensing by pulling on the lever 18. As explained with respect to FIG. 8, unlocking the sanitizer device is facilitated by a signal sent from a controller of the IoT device to the solenoids 80. The dispensing device is shown as being unlocked as indicated by the image 94 of the padlock being open.

Figure 11:
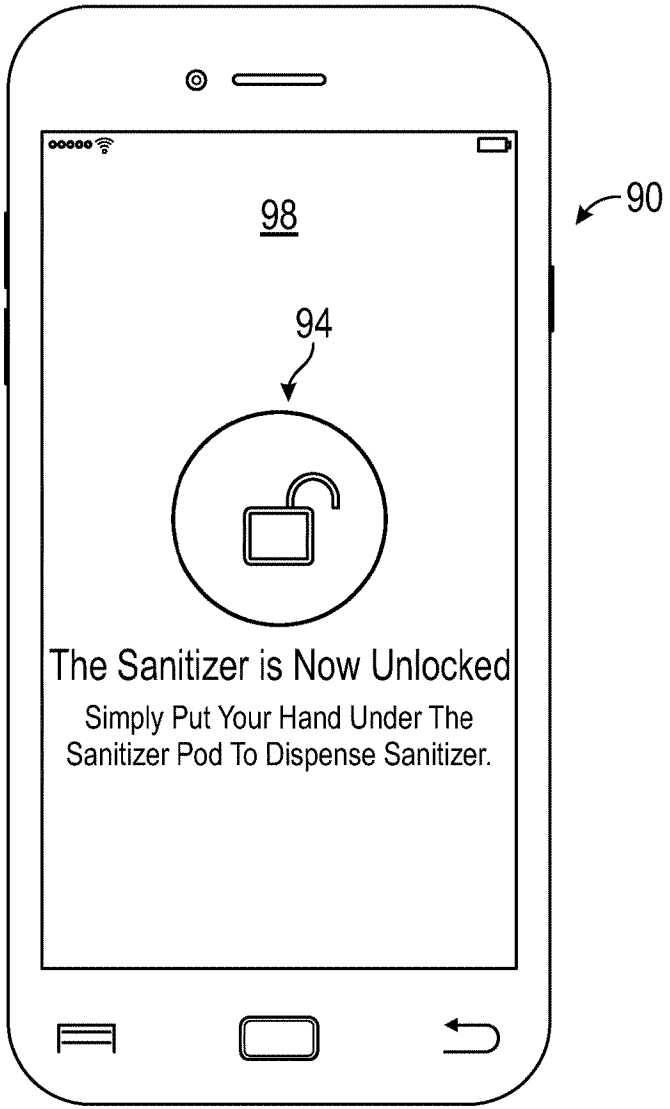
FIG. 11 is another sample user interface showing the device is unlocked and ready for use with respect activation of the device by a sensor.

FIG. 11 is another sample user interface 98 showing the device is unlocked and ready for use with respect to automatic activation of the device by a sensor. The dispensing device is shown as being unlocked as again indicated by the image 94 of the padlock being open. This UI 96 corresponds to the embodiment of the device that includes the sensor 32 that senses the presence of the user's hand(s). Unlocking the sanitizer device is facilitated by a power signal sent from the controller of the IoT device that powers the sensor 32. Thus, on/off control in this embodiment of the sanitizer device is simply achieved by selectively powering the sensor 32 that in turn activates the pump.

Figure 12:
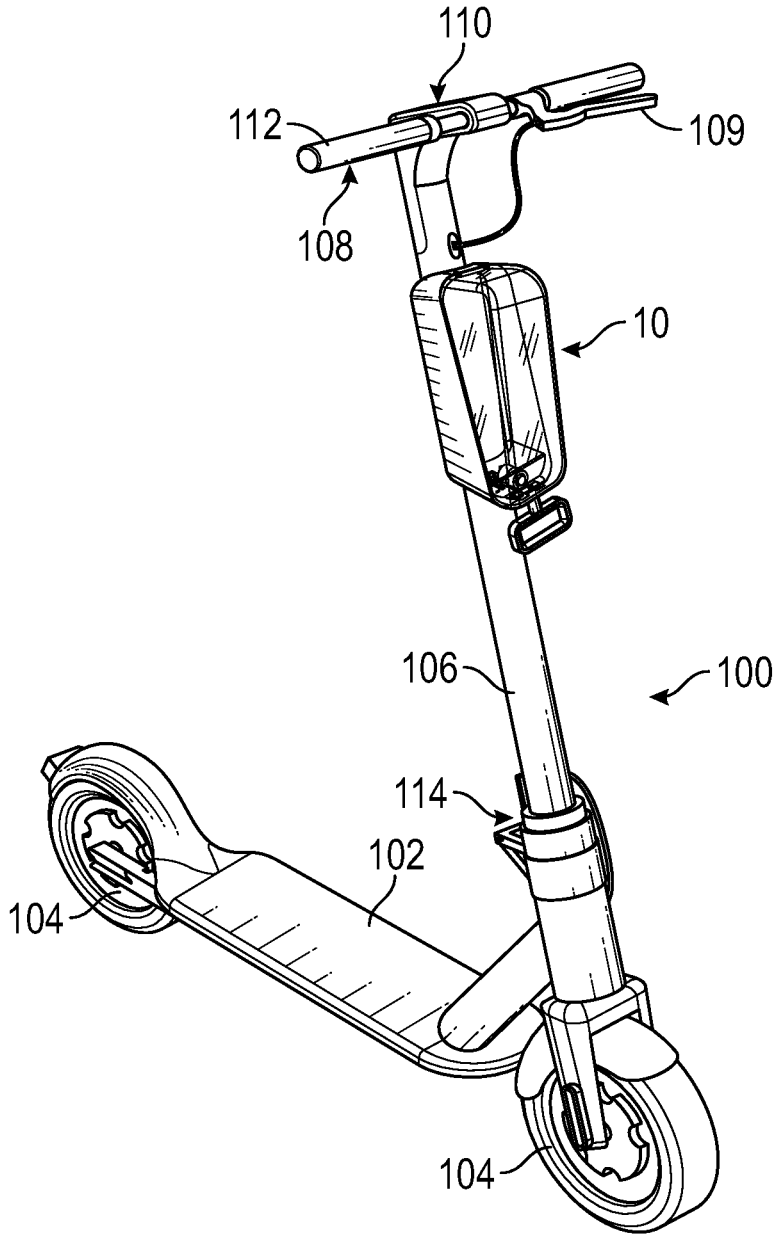
FIG. 12 is a perspective view of the dispensing device mounted to an example transport, namely, a scooter.

FIG. 12 shows a combination of the sanitizer dispensing device 10 and a transport, namely, a scooter 100. FIG. 12 is intended to represent any type of scooter device. The depicted example of the scooter 100 includes two wheels 104, a platform 102, and a vertical steering column or stem 106 with a transverse oriented handlebar 108. Additional details of the scooter are shown to include a hand brake 109, handle grips 112 and a clamp 114 to adjust the height of the steering column 106. The sanitizer device 10 is illustrated as being mounted to the upper end of the steering column with the outer shell of the sanitizer device facing forward. However, the sanitizer device can be mounted on the steering column at any desired orientation depending on the choice of the user/owner of the scooter. Similarly, the dispensing device can be mounted to a frame tube of a bicycle or other transport in any desired orientation.

In connection with use of the device with an IoT transport device, the scooter 100 may also represent such an IoT transport device in which the scooter incorporates IoT functionality. The IoT functionality may include a scanner 110 that is used to scan a QR code or other type of coded image on a UI of the user's mobile communication device that enables the user to complete a rental transaction.

According to another method of the invention, it involves the use of a mobile phone application (App) to control unlocking of the device by a user. According to this method, the hand sanitizer is mounted to the transport device of choice, such as an IoT scooter or bicycle. The structure of the hand sanitizing device is the same as described. Specifically, the method comprises: (a) providing a hand sanitizer device comprising an outer shell, an inner pod received through an open front of said outer shell, a front cover placed over a front surface of said inner pod, an actuator mounted in said shell, a pump communicating with said actuator, said pump having a nozzle opening for dispensing sanitizing fluid; (b) providing a first App installed on a mobile communication device, said App having a plurality of user interfaces enabling a user to select activation of said dispenser device; (c) conducting a rental transaction for a transport utilizing a second App such that the user executes the rental transaction by a QR code appearing on the user's mobile communication application that activates the transport; (d) using the first App to selectively unlock the sanitizer device for use; and (e) actuating said actuator to cause sanitizing fluid to be dispensed through said nozzle opening.

Although the invention has been described herein with respect to preferred embodiments of a device and method, it should be understood that the invention is not specifically limited to these preferred embodiments, and the scope of the invention should be defined commensurate with the appended claims.

What is claimed is:

1. A hand sanitizing dispensing device for dispensing a quantity of fluid therefrom, comprising:

an outer shell having top and bottom surfaces, lateral side surfaces, a rear surface with a concave shape and an open front;

an inner pod having continuous top and bottom surfaces, continuous lateral side surfaces, a continuous front surface, and an open rear thereby forming an enclosure, said inner pod received through said open front of said outer shell;

a front cover having top and bottom surfaces, lateral side surfaces, a front surface, and an open rear, said front cover placed over said front surface of said inner pod and said front cover having a rear edge that connects with a front edge of said shell;

an actuator mounted to said dispensing device;

a pump communicating with said actuator and having a dispense opening for dispensing sanitizing fluid;

wherein said actuator communicates with said pump to dispense sanitizing fluid by reciprocal motion of a lever of said actuator causing said pump to withdraw the sanitizing fluid within a container holding the sanitizing fluid, and subsequently causing the sanitizing fluid to be dispensed through said opening.

2. The dispensing device, as claimed in claim 1, wherein:

said actuator includes (a) an actuator plate that selectively contacts said pump (b) a rack and pinion combination, and (c) a stem connected to said lever at one end, and said stem connected to said rack and pinion combination at the other end; and wherein said lever is reciprocated causing corresponding reciprocation of a slidable piece of said pump thereby pressurizing the bag of sanitizing fluid.

3. A method of dispensing sanitizing fluid from a hand sanitizing dispensing device comprising:

providing a hand sanitizer device comprising:

an outer shell;

an inner pod received through an open front of said outer shell said inner pod having continuous top and bottom surfaces, continuous lateral side surfaces, a continuous front surface, and an open rear thereby forming an enclosure;

a front cover placed over a front surface of said inner pod and said front cover having a rear edge that connects with a front edge of said outer shell;

an actuator mounted to said hand sanitizer device;

a pump communicating with said actuator, said pump having a nozzle opening for dispensing sanitizing fluid; and actuating said actuator to cause sanitizing fluid to be dispensed through said nozzle opening.

4. The method, as claimed in claim 3, wherein:

said actuator includes a lever;

grasping the lever; and moving the lever causing said actuator to contact said pump to withdraw the sanitizing fluid within a container holding the sanitizing fluid, and subsequently causing the sanitizing fluid to be dispensed.

5. A method of dispensing sanitizing fluid from a hand sanitizing dispensing device mounted to an IoT transport device comprising:

providing a hand sanitizer device comprising an actuator mounted to said hand sanitizer device; a pump communicating with said actuator, said pump having a nozzle opening for dispensing sanitizing fluid;

providing a mobile communication device with an App that communicates with the IoT transport device;

operating the App to make a command to use the dispensing device including executing a purchase transaction of the IoT transport device in which a user also selects to use the dispenser device;

viewing a status of the dispensing device on a first user interface of the App to confirm the mobile communication device successfully communicated with the IoT device to operate the dispensing device, said first user interface including an instruction for a user to operate the dispensing device by unlocking the dispensing device; and actuating the actuator to cause sanitizing fluid to be dispensed through said nozzle opening, wherein said actuating step includes a second user interface indicating the dispensing device is unlocked and ready for use.

6. The method, as claimed in claim 5, wherein:

said hand sanitizer device comprises an outer shell, an inner pod received through an open front of said outer shell, a front cover placed over a front surface of said inner pod and an actuator mounted to the dispensing device, a pump mounted to the dispensing device and communicating with said actuator, and wherein said pump having a nozzle opening for dispensing sanitizing fluid.

7. The method, as claimed in claim 5, wherein:

said IoT transport device is a scooter; and mounting the hand sanitizer device to a steering column of the scooter.

8. In combination, a hand sanitizing dispensing device for dispensing a quantity of fluid therefrom mounted to a transport, namely, a scooter, said combination comprising:

a scooter;

a hand sanitizing device mounted to a steering column of the scooter, said hand sanitizing device comprising:

an outer shell having top and bottom surfaces, lateral side surfaces, a rear surface with a concave shape and an open front;

an inner pod having continuous top and bottom surfaces, continuous lateral side surfaces, a continuous front surface, and an open rear thereby forming an enclosure, said inner pod received through said open front of said outer shell;

a front cover having top and bottom surfaces, lateral side surfaces, a front surface, and an open rear, said front cover placed over said front surface of said inner pod and said front cover having a rear edge that connects with a front edge of said shell;

an actuator mounted to said dispensing device;

a pump communicating with said actuator and having a dispense opening for dispensing sanitizing fluid; and wherein said actuator communicates with said pump to dispense sanitizing fluid by reciprocal motion of said actuator causing said pump to withdraw the sanitizing fluid within a container holding the sanitizing fluid, and subsequently causing the sanitizing fluid to be dispensed through said opening.

* * * * *